US011333327B2

(12) United States Patent
Hu et al.

(10) Patent No.: US 11,333,327 B2
(45) Date of Patent: May 17, 2022

(54) SPOTLIGHT LAMP WITH SNAP-FIT ANTI-GLARE RING

(71) Applicant: OPPLE LIGHTING CO., LTD., Shanghai (CN)

(72) Inventors: Chuan Hu, Shanghai (CN); Yisheng Xiao, Shanghai (CN); Zicai Ma, Shanghai (CN); Zeyu Liu, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/102,029

(22) Filed: Nov. 23, 2020

(65) Prior Publication Data

US 2021/0080085 A1 Mar. 18, 2021

Related U.S. Application Data

(63) Continuation of application No. PCT/CN2019/086639, filed on May 13, 2019.

(30) Foreign Application Priority Data

May 22, 2018 (CN) ..... 201820767671.4

(51) Int. Cl.
*F21V 17/06* (2006.01)
*F21V 3/06* (2018.01)
(Continued)

(52) U.S. Cl.
CPC ..... *F21V 17/06* (2013.01); *F21V 3/0625* (2018.02); *F21V 5/04* (2013.01); *F21V 14/06* (2013.01); *F21V 17/164* (2013.01)

(58) Field of Classification Search
CPC ..... F21V 17/16; F21V 17/164
See application file for complete search history.

(56) References Cited

U.S. PATENT DOCUMENTS 3,872,296 A * 3/1975 Cohen ..... F21V 17/164 362/366
4,475,147 A * 10/1984 Kristofek ..... F21S 8/026 362/147

(Continued)

FOREIGN PATENT DOCUMENTS

CN 203857363 U 10/2014
CN 204420762 U 6/2015

(Continued)

OTHER PUBLICATIONS

International Search Report of PCT Application No. PCT/CN2019/086639 dated Jul. 24, 2019 with English translation (6p).

*Primary Examiner* — Rajarshi Chakraborty
*Assistant Examiner* — Michael Chiang
(74) *Attorney, Agent, or Firm* — Arch & Lake LLP

(57) ABSTRACT

A spotlight lamp includes a housing, a light emitting module, a lens, and an anti-glare ring. The housing has an opening. The light emitting module and the lens are both arranged inside the housing. The anti-glare ring is connected to the housing by a detachable snap-fit structure, and blocks an edge of the opening. The lens abuts between the light emitting module and the anti-glare ring. The disassembly and assembly process of the spotlight lamp provided by the embodiments of the present disclosure is very simple so that it is convenient for users to replace the lens to adjust the light emitting range.

12 Claims, 4 Drawing Sheets

(51) Int. Cl.

| | |
|---|---|
| ***F21V 5/04*** | (2006.01) |
| ***F21V 14/06*** | (2006.01) |
| ***F21V 17/16*** | (2006.01) |

(56) References Cited

U.S. PATENT DOCUMENTS

| | | | | |
|---|---|---|---|---|
| 9,057,505 | B2 * | 6/2015 | Liu | F21V 29/507 |
| 10,203,076 | B2 * | 2/2019 | Nguyen | F21S 8/026 |
| 10,436,420 | B2 * | 10/2019 | Xu | F21V 14/06 |
| 10,753,558 | B2 * | 8/2020 | Danesh | F21V 23/003 |
| 11,015,775 | B2 * | 5/2021 | Weyhaeghe | F21V 21/14 |
| 2007/0058374 | A1 * | 3/2007 | Dupre | F21V 17/16<br>362/341 |
| 2013/0016509 | A1 * | 1/2013 | Van de Ven | F21V 5/008<br>362/235 |
| 2013/0077320 | A1 * | 3/2013 | Duan | F21V 7/0091<br>362/297 |
| 2015/0085495 | A1 * | 3/2015 | Seki | F21S 8/02<br>362/310 |

FOREIGN PATENT DOCUMENTS

| | | | |
|---|---|---|---|
| CN | 204573789 | U | 8/2015 |
| CN | 205480578 | U | 8/2016 |
| CN | 206555728 | U | 10/2017 |
| CN | 208124135 | U | 11/2018 |
| JP | 2014170638 | A | 9/2014 |

* cited by examiner

SPOTLIGHT LAMP WITH SNAP-FIT ANTI-GLARE RING

CROSS-REFERENCE TO RELATED APPLICATIONS

This application is based upon and claims the priority of PCT patent application No. PCT/CN2019/086639 filed on May 13, 2019 which claims priority to the Chinese patent application No. 201820767671.4 filed on May 22, 2018, the entire content of all of which is hereby incorporated by reference herein for all purposes.

TECHNICAL FIELD

The present disclosure relates to the field of lighting technology, in particular to a spotlight lamp.

BACKGROUND

The spotlight lamp is a widely used indoor lighting and decorative lamp. With the increasing diversification of user requirements, more abundant requirements on light emitting angle of the spotlight lamp are put forward, and some users even want to freely adjust the light emitting angle of the spotlight lamp.

For the spotlight lamp, the light emitting angle is usually determined by the shape of the lens, and therefore if the light emitting angle of the spotlight lamp needs to be changed, the lens needs to be changed.

For the spotlight lamp in related technologies, in order to have a firm structure, the lens may be connected and fixed by a non-detachable method such as bonding. It is difficult for users to disassemble the spotlight lamp and replace the lens by themselves, and therefore the users cannot adjust the light emitting angle of the spotlight lamp by themselves.

SUMMARY

Embodiments of the present disclosure provide a spotlight lamp, so as to solve the abovementioned problems.

Embodiments of the present disclosure adopt the following technical solutions:

Embodiments of the present disclosure provide a spotlight lamp, which includes a housing, a light emitting module, a lens, and an anti-glare ring;

the housing has an opening, the light emitting module and the lens are both arranged inside the housing, the anti-glare ring is connected to the housing by a detachable snap-fit structure, and blocks an edge of the opening, and the lens abuts between the light emitting module and the anti-glare ring.

Preferably, in the abovementioned spotlight lamp, the snap-fit structure includes a buckle and a snap-fit opening, one of the buckle and the snap-fit opening is arranged on an inner wall of the housing, and the other of the buckle and the snap-fit opening is arranged on the anti-glare ring.

Preferably, in the abovementioned spotlight lamp, the buckle is arranged on the inner wall of the housing, and the snap-fit opening is arranged on the anti-glare ring.

Preferably, in the abovementioned spotlight lamp, the anti-glare ring includes an anti-glare portion and a connecting portion, the anti-glare portion is in an annular shape, the connecting portion is arranged on a side of the anti-glare portion and protrudes from the anti-glare portion along an axial direction of the annular shape, and the snap-fit opening is arranged on the connecting portion;

in a case where the anti-glare ring is connected to the housing, the anti-glare portion is coaxial with the opening and blocks the edge of the opening, and the connecting portion extends into the housing from the opening, and allow the buckle to be in snap-fit connected with the snap-fit opening.

Preferably, in the abovementioned spotlight lamp, a positioning slot is provided in the housing, the positioning slot and the buckle are staggered with each other in a circumferential direction, and in a case where the anti-glare ring is connected to the housing, the connecting portion and the positioning slot are in insertion connection for positioning.

Preferably, in the abovementioned spotlight lamp, a size of the connecting portion in an axial direction is larger than a size of the positioning slot in an axial direction, the connecting portion is provided with a positioning socket corresponding to the positioning slot, and in a case where the anti-glare ring is connected to the housing, the positioning socket and the positioning slot are in insertion connection for positioning.

Preferably, in the abovementioned spotlight lamp, a positioning portion is provided in the housing, the positioning portion is fixedly connected to the inner wall of the housing, and a gap is formed between an end of the positioning portion close to the opening and the inner wall to form the positioning slot.

Preferably, in the abovementioned spotlight lamp, a plurality of positioning portions are provided, and the plurality of positioning portions are sequentially arranged along the circumferential direction of the opening, a surface of the positioning portion away from the inner wall is a position limiting surface, the lens includes a main body and an outer edge, and the outer edge surrounds the main body;

in a case where the lens abuts between the light emitting module and the anti-glare ring, the outer edge and the position limiting surface are in contact with each other for limiting a position.

Preferably, in the abovementioned spotlight lamp, the anti-glare portion is provided with an elastic rib, and the elastic rib and the connecting portion are on a same side of the anti-glare portion;

in a case where the lens abuts between the light emitting module and the anti-glare ring, the elastic rib abuts against the outer edge and generates elastic deformation.

Preferably, in the abovementioned spotlight lamp, a surface of the buckle includes a first guide surface and a second guide surface, the first guide surface is closer to the opening than the second guide surface, the first guide surface gradually approaches an axis of the opening from a side close to the opening to a side close to the second guide surface, and the second guide surface gradually approaches the axis of the opening from a side away from the opening to the side close to the opening.

Preferably, in the abovementioned spotlight lamp, the first guide surface and the second guide surface are flat surfaces or curved surfaces.

Preferably, in the abovementioned spotlight lamp, materials of the housing and the anti-glare ring are plastic materials.

Preferably, in the abovementioned spotlight lamp, the spotlight lamp further includes a mounting metal ring and a decorative surface ring, the mounting metal ring surrounds a periphery of the opening and is fixedly connected to the housing, and the decorative surface ring is connected to the mounting metal ring and covers a ring surface of the mounting metal ring.

BRIEF DESCRIPTION OF THE DRAWINGS

The drawings described here are used to provide a further understanding of the present disclosure and constitute a part of the present disclosure. The exemplary embodiments and descriptions of the present disclosure are used to explain the present disclosure, and do not constitute an improper limitation of the present disclosure. In the drawings.

REFERENCE NUMERALS

Figure 1:
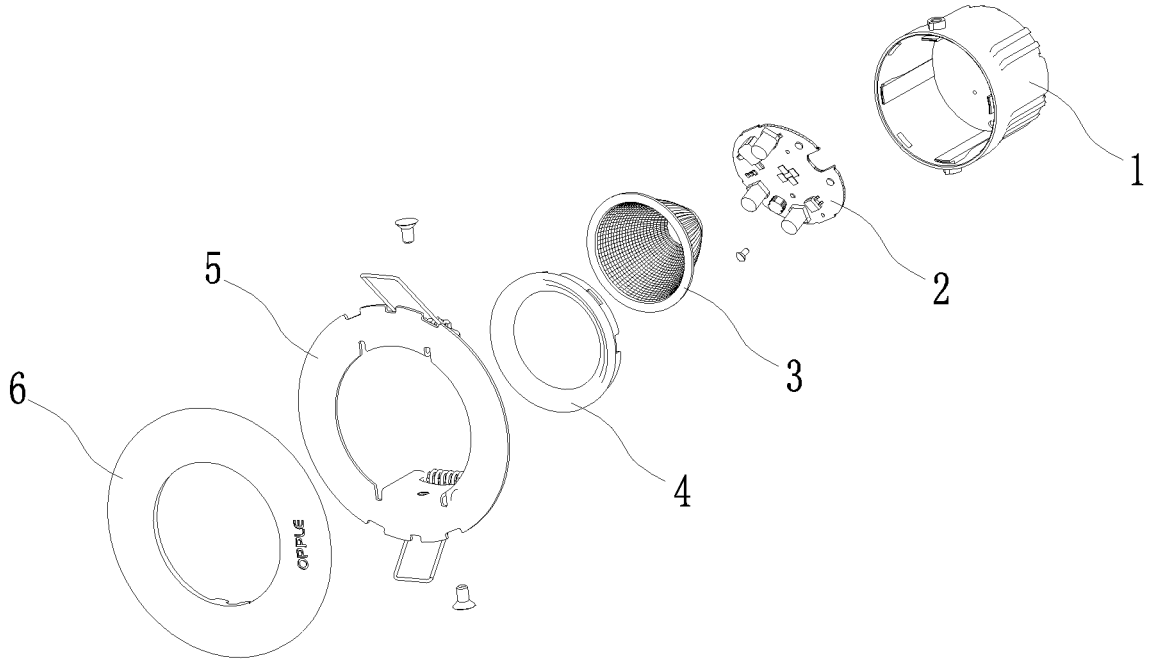
FIG. 1 is an explosion view of a spotlight lamp disclosed by an embodiment of the present disclosure.

1-housing; 10-opening; 12-inner wall; 14-positioning slot; 16-positioning portion; 160-position limiting surface; 2-light emitting module; 3-lens; 30-main body; 32-outer edge; 4-anti-glare ring; 40-anti-glare portion; 42-connecting portion; 44-positioning socket; 46-elastic rib; 5-mounting metal ring; 6-decorative surface ring; 70-buckle; 700-first guide surface; 702-second guide surface; 72-snap-fit opening.

DETAILED DESCRIPTION

In order to make objects, technical solutions and advantages of the present disclosure apparent, the technical solutions of the embodiments will be described in a clearly and fully understandable way in connection with the drawings related to the embodiments of the disclosure. It is apparent that the described embodiments are just a part but not all of the embodiments of the disclosure. Based on the described embodiments herein, those skilled in the art may obtain other embodiment, without any creative work, which shall be within the scope of the disclosure.

Hereinafter, technical solutions of each embodiment of the present disclosure will be described in detail with reference to the accompanying drawings.

Embodiments of the present disclosure disclose a spotlight lamp, as illustrated by FIG. 1-FIG. 6, the spotlight lamp includes a housing 1, a light emitting module 2, a lens 3, and an anti-glare ring 4, and may further include a mounting metal ring 5 and a decorative surface ring 6. The housing 1 is a main protective structure for the spotlight lamp, and the housing 1 has an opening 10. The light emitting module 2 is the light source of the spotlight lamp, and generally includes light emitting diode (LED) lamp beads and a substrate. The lens 3 is a light distribution component, and is used to adjust the light emitting angle of the light emitting module 2, the light emitting module 2 and the lens 3 are both arranged inside the housing 1. The anti-glare ring 4 is connected to the housing 1 by a detachable snap-fit structure, and blocks an edge of the opening 10, and the lens 3 abuts between the light emitting module 2 and the anti-glare ring 4. The usual function of the anti-glare ring 4 is to shield light, control the light exit angle of the spotlight lamp, and prevent glare. In one or more embodiments, the anti-glare ring 4 also has another function, that is, the anti-glare ring 4 abuts and fixes the lens 3.

Because the anti-glare ring 4 and the housing are connected by a detachable snap-fit structure, in a case where the user needs to replace the lens 3, the anti-glare ring 4 may be removed by manually releasing the snap-fit structure, and the lens 3 can naturally slide out through the opening 10 after the abutting of the anti-glare ring 4 is lost, it is convenient for the user to replace another lens. The disassembly and assembly process is very simple.

Figure 2:
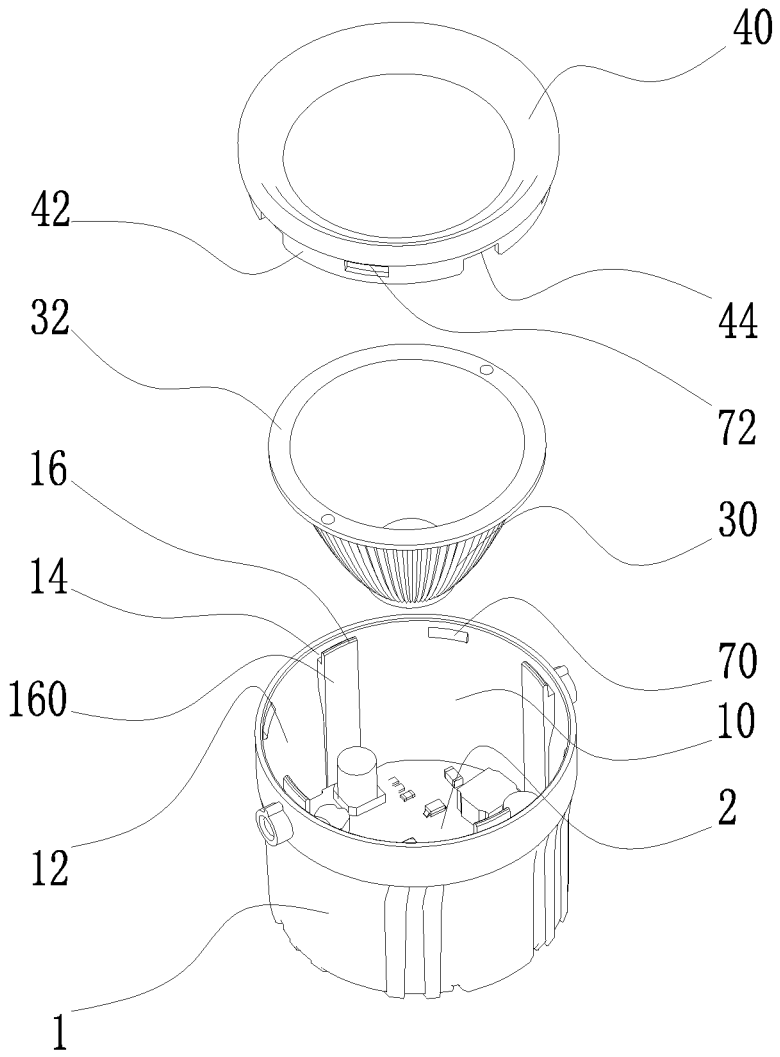
FIG. 2 is an explosion view of a housing, a light emitting module, a lens and an anti-glare ring disclosed by an embodiment of the present disclosure.
Figure 3:
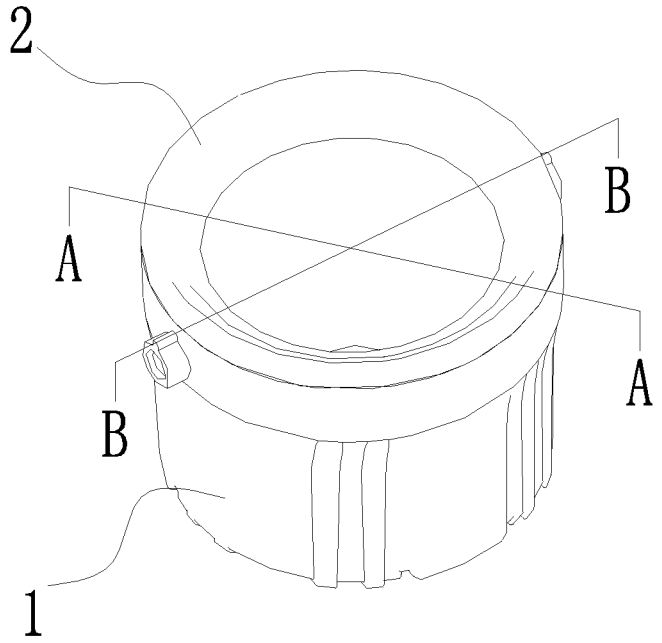
FIG. 3 is an assembly view of each structure in FIG. 2.
Figure 4:
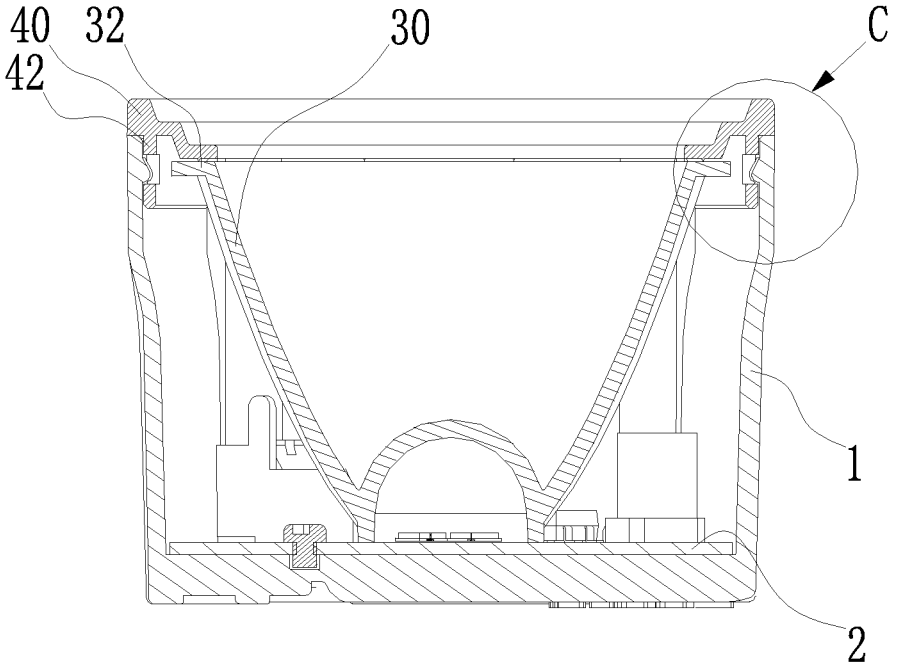
FIG. 4 is a cross-sectional view of FIG. 3 along an A-A direction.

As illustrated by FIG. 2 and FIG. 4, the snap-fit structure includes a buckle 70 and a snap-fit opening 72. One of the buckle 70 and the snap-fit opening 72 is arranged on the inner wall 12 of the housing 1, and the other is arranged on the anti-glare ring 4. The snap-fit opening 72 may be a blind hole or may also be a through hole. Theoretically, both the buckle 70 and the snap-fit opening 72 can be set at any position, which has no effect on the snap-fit connection. However, because the housing 1 is an appearance component, aesthetics needs to be considered. Therefore, if the snap-fit opening 72 is arranged on the housing 1, in order to prevent the snap-fit opening 72 from being exposed, the snap-fit opening 72 can became a blind hole only by increasing the wall thickness of the housing 1. However, although this method prevents the buckle 70 and the snap-fit opening 72 from appearing on the appearance surface of the housing 1, it will greatly increase the size and cost of the housing 1.

Therefore, in one or more embodiments, it is recommended that the buckle 70 be provided on the inner wall 12 of the housing 1 and the snap-fit opening 72 be provided on the anti-glare ring 4. In this way, the snap-fit structure will be inside the housing 1 after the snap-fit connection, which has no effect on the appearance.

As illustrated by FIG. 2 and FIG. 4, the anti-glare ring 4 includes an anti-glare portion 40 and a connecting portion 42. The anti-glare portion 40 is in an annular shape, and the connecting portion 42 is provided on a side of the anti-glare portion 40 and protrudes from the anti-glare portion 40 along an axial direction of the annular shape, and the snap-fit opening 72 is provided on the connecting portion 42.

In a case where the anti-glare ring 4 is connected to the housing 4, the anti-glare portion 40 blocks an edge of the opening 10, so as to block the light of the light emitting module 2 and prevent glare. The anti-glare portion 40 may be all located inside the opening 10, but in consideration of aesthetics and simplified assembly process, the anti-glare portion 40 may also cover the surface of the housing 1 surrounding the opening 10. The anti-glare portion 40 may also be in a stepped tapered structure, the outer side of which covers the surface of the housing 1 surrounding the opening 10, and the inner portion extends into the inside of the opening 10. Therefore, an embedded structure is formed to improve positioning accuracy.

The connecting portion 42 extends into the inside of the housing 1 through the opening 10 and allows the buckle 70 to be in snap-fit connection with the snap-fit opening 72. The number of the buckle 70 and the snap-fit structure 72 is usually arranged in multiple along the circumferential direction. In this case, the connecting portion 42 may be in a multi-segment structure arranged in the circumferential direction, or may be in a complete ring structure.

Figure 6:
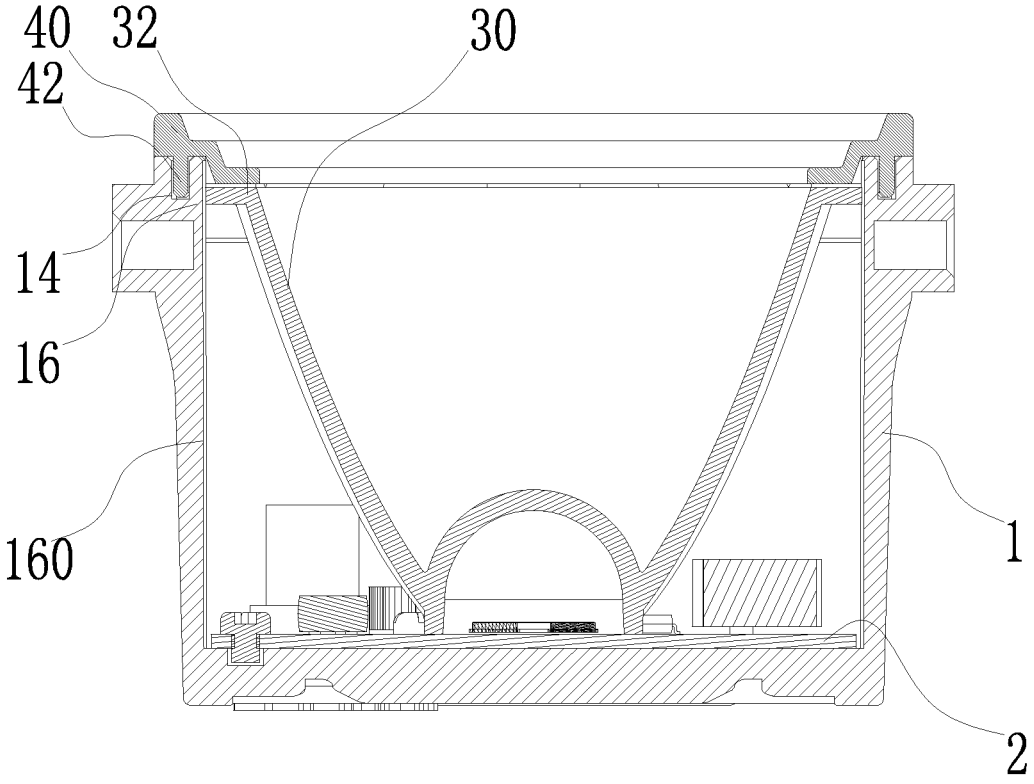
FIG. 6 is a cross-sectional view of FIG. 3 along a B-B direction.

In order to further facilitate the positioning between the anti-glare ring 4 and the housing 1, a positioning slot 14 may be provided in the housing 1. In order to prevent the positioning slot 14 from affecting the snap-fit process, the positioning slot 14 and the buckle 70 need to be staggered with each other in the circumferential direction of the opening 10. In a case where the anti-glare ring 4 is connected to the housing 1, the connecting portion 42 and the positioning slot 14 are in insertion connection for positioning. The positioning slot 14 can locate the radial position of the anti-glare ring 4 and can also locate the axial position of the anti-glare ring 4. As illustrated by FIG. 2 and FIG. 6, as a preferred solution, a size of the connecting portion 42 in the axial direction may be designed to be larger than a size of the positioning slot 14 in the axial direction, and a positioning socket 44 corresponding to the positioning slot 14 is provided on the connecting portion 42, in a case where the anti-glare ring 4 is connected to the housing 1, the positioning socket 44 and the positioning slot 14 are in insertion connection for positioning. Because the size of the connecting portion 42 in the axial direction is larger than the size of the positioning slot 14, the circumferential rotation of the connection portion 42 will be blocked by the positioning slot 14, so that the positioning slot 14 also locates the circumferential position of the anti-glare ring 4, which is more convenient for the snap-fit connection of the buckle 70 and the snap-fit opening 72.

In one or more embodiments, a positioning portion 16 may be provided in the housing 1, and the positioning portion 16 is fixedly connected to the inner wall 12 of the housing 1. There is a gap formed between an end of the positioning portion 16 close to the opening 10 and the inner wall 12, and the gap forms the positioning slot 14. In a case where a plurality of positioning slots 14 are needed, the plurality of positioning portions 16 may be arranged in sequence along the circumferential direction of the opening 10.

In one or more embodiments, although the lens 3 is abutted by the light emitting module 2 and the anti-glare ring 4, because the light emitting module 2 and the anti-glare ring 4 are respectively located at two ends of the lens 3, the light emitting module 2 and the anti-glare ring 4 cannot locate the position of the lens 3 in the radial direction, especially during the assembly process, the position of the lens 3 in the radial direction is more difficult to be located. After the assembling is completed, the light emitting module 2 and the anti-glare ring 4 can only rely on friction to limit the position in the radial direction. In the cases of collision or the like, the lens 3 receives a large force, which easily causes the radial displacement of the lens 3.

In order to avoid the above problems, further referring to FIG. 2 and FIG. 6, in one or more embodiments, a surface of the positioning portion 16 away from the inner wall 12 may be used as a position limiting surface 160, and a plurality of position limiting surfaces 160 surround as a ring. The lens 3 includes a main body 30 and an outer edge 32. The outer edge 32 surrounds the main body 30, that is, the outer edge 32 is at the outermost periphery of the lens 3. In a case where the lens 3 abuts between the light emitting module 2 and the anti-glare ring 4, the outer edge 32 contacts these position limiting surfaces 160 for limiting the position, thereby limiting the radial position of the lens 3.

In order to further improve the abutting effect of the anti-glare ring 4 on the lens 3, an elastic rib 46 may be provided on the anti-glare portion 40, and the elastic rib 46 and the connecting portion 42 are located on the same side of the anti-glare portion 40. The elastic rib 46 may be in a multi-segment structure or may also be in a ring structure. The side of the elastic rib 46 away from the anti-glare portion 40 may also be appropriately reduced in area to form a sharper edge. In a case where the lens 3 abuts between the light emitting module 2 and the anti-glare ring 4, the elastic rib 46 abuts the outer edge 32 and generates elastic deformation. Because the area of the side of the elastic rib away from the anti-glare portion 40 is small, the elastic rib 46 and the outer edge 32 will have greater friction after abutting and deforming, so that the lens 3 has a better abutting effect.

Figure 5:
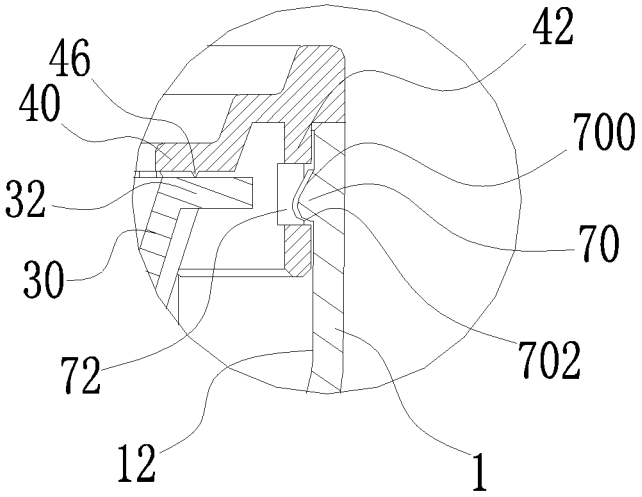
FIG. 5 is a partial enlarged view of a part C in FIG. 4.

In order to facilitate the user to disassemble and assemble the anti-glare ring 4 with bare hands, as illustrated by FIG. 5, a first guide surface 700 and a second guide surface 702 may be provided on the surface of the buckle 70. The first guide surface 700 is closer to the opening 10 than the second guide surface 702, the first guiding surface 700 gradually approaches an axis of the opening 10 from a side close to the opening 10 to a side close to the second guiding surface 702, and the second guiding surface 702 gradually approaches the axis of the opening 10 from a side away from the opening 10 to a side close to the opening 10.

In a case where the buckle 70 is in snap-fit connection with the snap-fit opening 72, the first guide surface 700 of the buckle 70 functions to guide the buckle 70 to slide toward the snap-fit opening 72. In a case where the anti-glare ring 4 needs to be removed, the second guide surface 702 functions to allow the buckle 70 to be easily separated from the snap-fit opening 72. The first guide surface 700 and the second guide surface 702 may be flat surfaces or curved surfaces. In addition, the first guide surface 700 and the second guide surface 702 may be directly connected, or there may be a transition surface. In order to facilitate the snap-fit connection, it is recommended that the housing 1 and the anti-glare ring 4 in one or more embodiments be made of plastic materials with better elasticity.

The mounting metal ring 5 is used to embed the spotlight lamp in a spotlight lamp hole. The mounting metal ring 5 surrounds the periphery of the opening 10 and is fixedly connected to the housing 1. The fixing method usually adopts screws. The decorative surface ring 6 is a decorative structure, the decorative surface ring 6 and the mounting metal ring 5 are detachably connected through a snap-fit method or other methods, and the decorative surface ring covers a ring surface of the mounting metal ring 5.

The disassembly and assembly process of the spotlight lamp provided by the embodiments of the present disclosure is very simple so that it is convenient for users to replace the lens to adjust the light emitting range.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

At least one of the abovementioned technical solutions provided by the embodiments of the present disclosure can achieve the following beneficial effects. In the spotlight lamp disclosed by the embodiments of the present disclosure, the lens abuts and is fixed in the housing through the light-emitting module and the anti-glare ring connected to the housing by a detachable snap-fit structure. In a case where the user needs to replace the lens, the user only needs to manually release the snap-fit structure to remove the anti-glare ring, and the lens can slide out naturally through the opening after losing the abutting of the anti-glare ring, so that the user can replace other lenses. The disassembly and assembly processes are very convenient.

The above embodiments of the present disclosure focus on the differences between the respective embodiments. As long as the different optimization features in the respective embodiments are not contradictory, the different optimization features can be combined to form a better embodiment. Considering the simplicity of the text, it is not repeated here.

The above descriptions are only specific embodiments of the present disclosure, and are not used to limit the present disclosure, those skilled in the art may make some improvements and modifications within the technical spirit and principle of the present disclosure, and the modifications, equivalent substitution, and improvements should be within the protection scope of claims of the present disclosure.

What is claimed is:

1. A spotlight lamp, comprising:

a housing having an opening, a light emitting module and a lens arranged inside the housing, and an anti-glare ring connected to the housing by a detachable snap-fit structure, wherein the anti-glare ring blocks an edge of the opening, and wherein the lens abuts between the light emitting module and the anti-glare ring;

wherein the detachable snap-fit structure comprises a buckle and a snap-fit opening, a positioning slot is disposed in the housing, and the positioning slot and the buckle are staggered with each other in a circumferential direction;

wherein the anti-glare ring comprises an anti-glare portion and a connecting portion, the anti-glare portion is in an annular shape, the connecting portion is arranged on a side of the anti-glare portion and protrudes from the anti-glare portion along an axial direction of the annular shape; and the connecting portion extends into the housing from the opening; and wherein the anti-glare ring is connected to the housing, the connecting portion and the positioning slot are in insertion connection for positioning.

2. The spotlight lamp according to claim 1, wherein one of the buckle and the snap-fit opening is arranged on an inner wall of the housing, and the other of the buckle and the snap-fit opening is arranged on the anti-glare ring.

3. The spotlight lamp according to claim 2, wherein the buckle is arranged on the inner wall of the housing, and the snap-fit opening is arranged on the anti-glare ring.

4. The spotlight lamp according to claim 3, wherein the snap-fit opening is arranged on the connecting portion;

where the anti-glare ring is connected to the housing, the anti-glare portion is coaxial with the opening and blocks the edge of the opening, and allows the buckle to be in snap-fit connection with the snap-fit opening.

5. The spotlight lamp according to claim 4, wherein a size of the connecting portion in an axial direction is larger than a size of the positioning slot in an axial direction, the connecting portion is provided with a positioning socket corresponding to the positioning slot, and where the anti-glare ring is connected to the housing, the positioning socket and the positioning slot are in insertion connection for positioning.

6. The spotlight lamp according to claim 4, wherein a positioning portion is provided in the housing, the positioning portion is fixedly connected to the inner wall of the housing, and a gap is formed between an end of the positioning portion close to the opening and the inner wall to form the positioning slot.

7. The spotlight lamp according to claim 6, wherein a plurality of positioning portions are provided, and the plurality of positioning portions are sequentially arranged along the circumferential direction of the opening, a surface of the positioning portion away from the inner wall is a position limiting surface, the lens comprises a main body and an outer edge, and the outer edge surrounds the main body;

where the lens abuts between the light emitting module and the anti-glare ring, the outer edge and the position limiting surface are in contact with each other for limiting a position.

8. The spotlight lamp according to claim , wherein the anti-glare portion is provided with an elastic rib, and the elastic rib and the connecting portion are on a same side of the anti-glare portion;

where the lens abuts between the light emitting module and the anti-glare ring, the elastic rib abuts against the outer edge and generates elastic deformation.

9. The spotlight lamp according to claim 3, wherein a surface of the buckle comprises a first guide surface and a second guide surface, the first guide surface is closer to the opening than the second guide surface, the first guide surface gradually approaches an axis of the opening from a side close to the opening to a side close to the second guide surface, and the second guide surface gradually approaches the axis of the opening from a side away from the opening to the side close to the opening.

10. The spotlight lamp according to claim 9, characterized in that, the first guide surface and the second guide surface are flat surfaces or curved surfaces.

11. The spotlight lamp according to claim 1, wherein materials of the housing and the anti-glare ring are plastic materials.

12. The spotlight lamp according to claim 1, wherein the spotlight lamp further comprises a mounting metal ring and a decorative surface ring, the mounting metal ring surrounds a periphery of the opening and is fixedly connected to the housing, and the decorative surface ring is connected to the mounting metal ring and covers a ring surface of the mounting metal ring.

* * * * *